United States Patent [19]

Johnston

[11] 4,005,813

[45] Feb. 1, 1977

[54] SINGLE-OPENING BEER KEG AND METHOD OF PRODUCING FROM CONVENTIONAL KEG

[76] Inventor: Mack S. Johnston, 1065 Lomita Blvd., No. 220, Harbor City, Calif. 90710

[22] Filed: Oct. 6, 1975

[21] Appl. No.: 620,146

[52] U.S. Cl. ..... 228/184; 113/120 M

[51] Int. Cl.[2] ..... B23K 31/02; B21D 51/00

[58] Field of Search ..... 228/184, 119; 220/5 R, 220/85 P, DIG. 1, DIG. 29; 113/120 M, 120 L, 120 N, 120 QA, 1 M

[56] References Cited

UNITED STATES PATENTS

| | | | |
|---|---|---|---|
| 1,483,293 | 2/1924 | Foster | 113/120 L |
| 1,572,727 | 2/1926 | Kerr | 220/85 P |
| 1,788,261 | 1/1931 | Werder | 113/120 M |
| 2,339,544 | 1/1944 | Stanley | 113/120 L |
| 3,660,188 | 5/1972 | VanLeer | 113/120 M |
| 3,729,812 | 5/1973 | Thomas | 113/120 M |

*Primary Examiner*—Al Lawrence Smith
*Assistant Examiner*—Margaret Joyce
*Attorney, Agent, or Firm*—Wills, Green & Mueth

[57] ABSTRACT

A single-opening beer keg is produced from a beer keg of conventional configuration which has a bung hole in the side wall and a dispensing opening in the top wall thereof, by closing the dispensing opening and the bung hole; moving the top wall inwardly to provide a wall of substantially spherical configuration and with an inner peripheral chine; moving the center portion of the bottom wall outwardly until it is in substantial horizontal alignment with the lower end of the side wall; and providing an opening in the center portion of the bottom wall to receive a valve assembly. An annular protective collar can be secured to the lower end of the side wall to protect the valve assembly during shipment of the keg.

4 Claims, 5 Drawing Figures

SINGLE-OPENING BEER KEG AND METHOD OF PRODUCING FROM CONVENTIONAL KEG

BACKGROUND AND SUMMARY OF THE INVENTION

The present invention relates generally to the container art, and more particularly to a novel single-opening beer keg and method of producing it from a conventional keg.

As is well known in the draft beer keg art, there are various shapes and types of beer kegs, with several different types of dispensing openings in the top wall thereof, the two most widely used openings in the United States being the "Golden Gate" keg which as a 1½ inch dispensing opening, and the "Peerless" keg, which has a ¾ inch dispensing opening. Because of the different sizes and types of dispensing openings, it has been necessary to use a variety of different tapping units at the taverns or restaurants where the draft beer is being dispensed.

Also, for many years and up to the present time, substantially all commercial beer kegs have been filled with beer through an opening in the side wall, which opening is subsequently closed with a wooden bung or plug. This presents several problems. Thus, prior to washing and refilling the keg with beer, the old wooden plug or bung is removed with a special screw augar which cuts into the bung and pulls it out of the opening. However, often times the bung will split into pieces and such pieces and chips will fall into the keg, thereby requiring special efforts to remove the pieces and chips and a further inspection to make certain that all have been removed.

After a keg has been filled with beer by means of a filling rod which is inserted through the aforementioned bung hole, the hole is closed with a wooden plug or bung which is usually manually driven into place with a sledge hammer. If the first bung does not effectively close the opening, it is not uncommon to place a second bung on top of the first one, and to drive the first bung into the keg. There might be dirt and bacteria on the outer face of the first bung where the sledge hammer struck it, and this could contaminate the beer.

Obviously, the manual removal of a bung from an empty keg, with the accompanying inspection to make certain that all chips have been removed, the washing and draining of the keg, the turning of the keg and filling of it with beer, and the manual driving of a bung into the hole after the keg has been filled with beer . . . are very time consuming operations and materially add to the cost of a keg of beer.

Being familiar with the aforementioned problems, I invented a tapper unit which can be used with various types of conventional keg units, and also invented a universal valve system to be mounted in one wall of a keg, whereby the same opening can be used for washing the keg, filling it with beer, and then dispensing the beer therefrom. Such a universal valve system is shown and described in U.S. Pat. No. 3,880,182, the assembly being preferably mounted in the end wall of a keg.

Because it is preferable to use a relatively large opening with my universal valve system so as to greatly reduce the time for washing the keg and for filling it with beer, I first contemplated having new kegs made with generally the same type of bottom wall construction, but without a bung hole in the side wall and with a modified top wall construction with a relatively large opening for receiving the universal valve system, and also containing means for draining the wash fluid from the keg and through the opening during the washing operation.

However, there are millions of servicable beer kegs of conventional configuration in use in the United States at the present time, and it would require the expenditure of large sums of money by the breweries to purchase new kegs for use with my universal valve system. Also, the amount of material and the time required for producing all new kegs, might make a conversion to the one-hole, universal valve system difficult to accomplish within a reasonable period of time.

With the aforementioned difficulties in mind, it is an object of the present invention to provide a novel single-opening beer keg which is produced by modifying a conventional keg. More particularly, it is an object to provide a method for modifying beer kegs of conventional construction, to provide a keg which can be washed, filled with beer and the beer dispensed through a single opening contained in an end wall.

Another object is to provide a method of converting conventional beer kegs to provide an opening in an end wall thereof, whereby the keg can be washed, filled with beer and the beer dispensed through said opening. More particularly, it is an object to provide such a method whereby the end wall which was the bottom wall of the keg becomes the top wall thereof, with the chine and the trough in what was the bottom wall, providing the means in the top wall for draining the water from the keg during the washing operation.

Yet another object is to provide such a method of converting conventional kegs to single-opening kegs, which requires very little additional material and a relatively small amount of time for achieving such a conversion.

A further object is to provide a beer keg which can be washed, filled with beer, and the beer dispense therefrom . . . all through the same opening contained in an end wall . . . which keg is produced by converting a conventional beer keg, utilizing a small amount of additional material and which is accomplished in a relatively short period of time.

I have discovered that the foregoing objects and advantages are achieved by moving the center portion of the bottom wall of a conventional keg outwardly until the center portion is in substantial horizontal alignment with the end of the side wall, providing an opening in the center portion of the bottom wall for receiving a valve assembly, closing the normal dispensing opening in the top wall, and moving the center portion of the top wall inwardly to provide a substantially cylindrical portion with an inner peripheral chine.

DESCRIPTION OF THE PREFERRED EMBODIMENT

Figure 1:
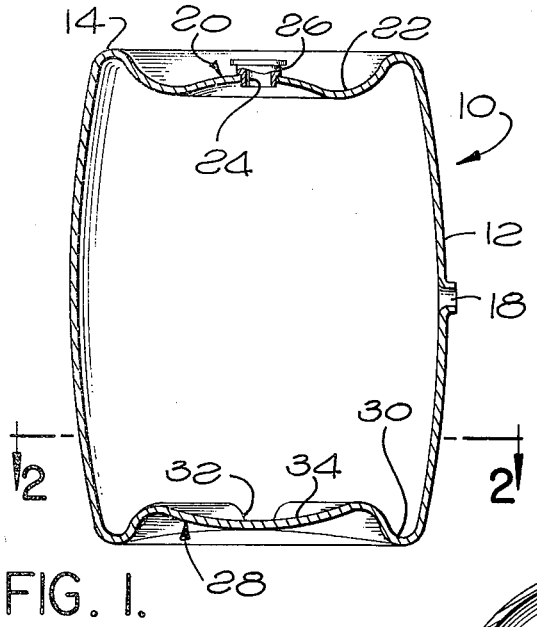
FIG. 1 is a vertical sectional view of a beer keg of conventional construction, prior to being modified.

Referring to the drawing more particularly by reference numerals, specifically FIG. 1, the number 10 indicates a beer keg of conventional configuration, which includes a side wall 12 with an upper end 14 and a lower end 16, the side wall being provided with a bung hole 18 which is normally used for filling the keg with beer.

The keg also includes a top wall 20 which is offset inwardly of the upper end 14 and which includes an annular, inwardly-extending trough 22 surrounding a center portion. A dispensing opening 24 provided with an annular collar 26 is contained in the center portion of the top wall 20.

The bottom wall 28 is offset inwardly of the lower end 16, and includes an inner peripheral annular chine 30 which normally receives the lower end of a siphon tube, and a radially-extending trough 32 (FIG. 2) which interconnects the center well 34 of the bottom wall with the chine 30, whereby all of the beer can be siphoned from the keg at the chine during normal usage.

Figure 3:
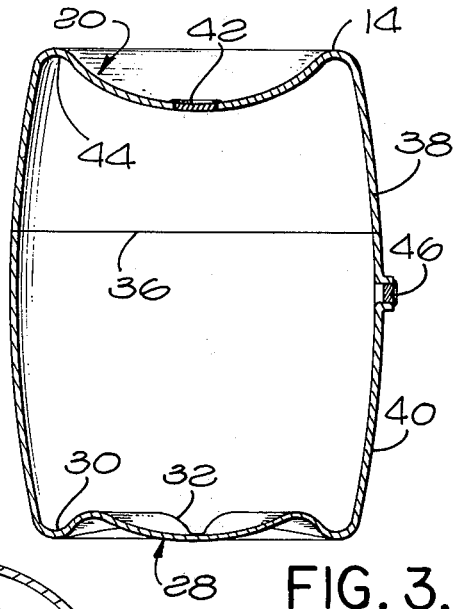
FIG. 3 is a vertical sectional view of the keg of FIG. 1, after it has been partially modified.

As a first step in modifying or converting the keg 10, the keg is preferably cut into two sections along a horizontal line 36 (FIG. 3), thereby providing a top part 38 and a bottom part 40.

Considering first the top part 38, the collar 26 around the opening 24 is removed, and a plate 42 welded in the opening.

The top part is then placed in a die (not shown) and the center portion of the top wall forced inwardly (FIG. 3) until the center portion is substantially spherical in shape and with an inner peripheral chine 44 adjacent the side wall.

Regarding the bottom part 40, a disc 46 is welded in or over the bung hole 18, and the bottom part placed in a die (not shown) and the bottom wall 28 forced outwardly (FIG. 3) until the center portion thereof is in substantial horizontal alignment with the lower end 16 of the side wall.

Figure 4:
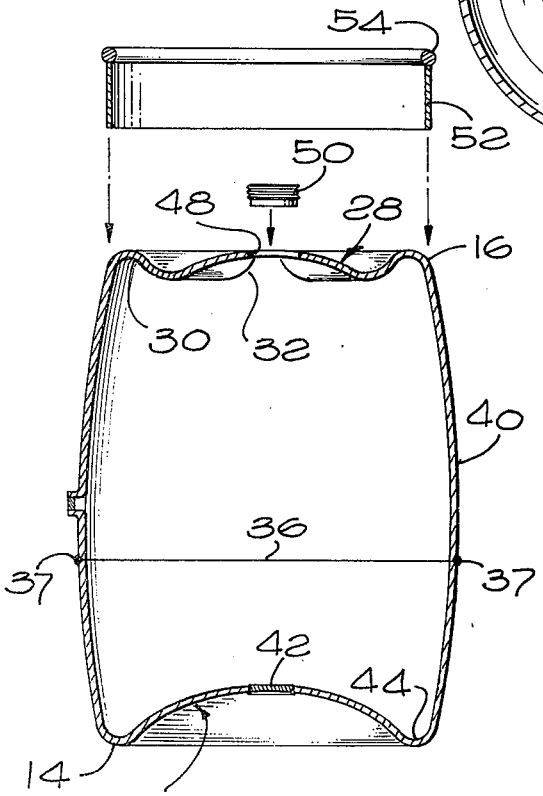
FIG. 4 is an exploded, vertical sectional view of a partially modified keg, illustrating the additional parts which are required to complete the modification.

A circular opening 48 (FIG. 4) is cut in what was the bottom wall 28 . . . which now becomes the top wall . . . and an externally threaded annular ring 50 is welded in said opening for a purpose to appear.

The two parts of the keg are then welded together along the line 36, as at 37, and the keg turned end for end, whereby the top becomes the bottom, and vice versa.

Figure 5:
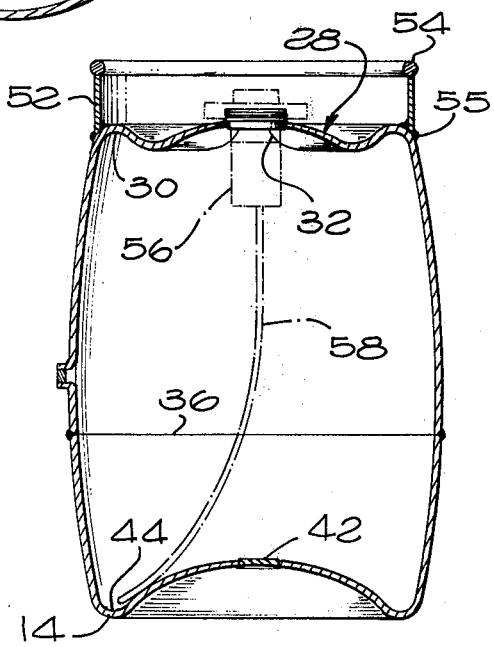
FIG. 5 is a vertical, sectional view of a keg which has been modified utilizing the teachings of the present invention.

A protective annular collar 52 (FIG. 4) with a ring 54 secured to the outer end thereof, is welded onto what was the lower end 16 of the side wall of the keg, as at 55, thereby completing the modification and resulting in the configuration shown in FIG. 5.

Figure 2:
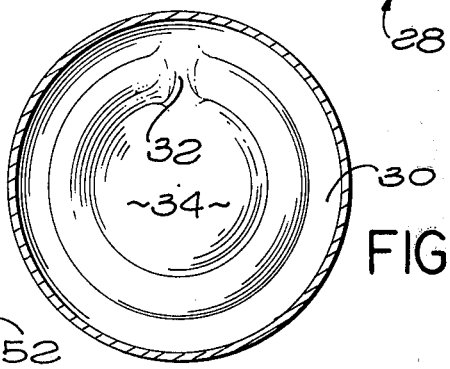
FIG. 2 is a horizontal sectional view taken on the line 2—2 in FIG. 1.

Thereafter, a universal valve assembly 56 (FIG. 5) . . . similar to the valve assembly identified by the number 140 of FIG. 10 of U.S. Pat. No. 3,880,182 . . . can be mounted on the ring 50. Such a valve assembly 56 includes a siphon tube 58 which extends into the chine 44, for removing all of the beer from the keg during the dispensing operation. If desired, instead of welding the ring 50 in the opening 48, a different type of valve assembly . . . as shown in FIGS. 1 and 2 of U.S. Pat. No. 3,880,182 . . . can be welded directly into the opening 48. However, as described in the aforementioned patent, it is preferable to have a removable valve assembly for cleaning purposes.

Thus, with the trough 32 in the end wall 28 which contains the universal valve assembly 56, said end wall can be directed downwardly and the interior of the keg washed as described in U.S. Pat. No. 3,880,182, whereby the wash water can drain from the chine 30, into the trough 32, and out through the opening 48.

It is to be understood that the sequence of the conversion steps can be changed, and that the end walls can be moved to the modified positions without cutting the keg into two parts . . . as by placing the keg in a two-ended die and using hydraulic pressure through the bung hole 18.

Thus, it is apparent that there has been provided a novel method of producing a single-opening beer keg from a beer keg of conventional configuration, and a resultant converted keg which can be washed, filled with beer and the beer dispensed therefrom through a single opening contained in an end wall.

I claim:

1. The method of modifying a keg which has a side wall with an upper end and a lower end, and which further includes a top wall containing a dispensing opening, and a recessed bottom wall containing an internal, peripheral chine with a radially-extending trough interconnecting said chine with the center portion of the bottom wall, including the steps of:

moving the center portion of the bottom wall outwardly until the center portion thereof is in substantial horizontal alignment with the lower end of the side wall;

providing an opening in the center portion of the bottom wall for receiving a valve assembly;

closing the dispensing opening in the top wall; and moving the center portion of the top wall inwardly to provide a generally spherical portion with an inner peripheral chine.

2. The method of modifying a keg according to claim 1, in which the side wall of the keg contains a bung hole, and said bung hole is permanently closed during the modification of the keg.

3. The method of modifying a keg according to claim 1, which includes the further step of providing an annular protective collar and securing said collar to the upper end of the side wall.

4. The method of modifying a keg according to claim 1, which includes the step of separating the keg into an upper portion and a lower portion prior to moving the top and bottom walls relative to the upper and lower ends of the keg.

* * * * *